US005655394A

United States Patent [19]

DiRocco, Jr.

[11] Patent Number: 5,655,394

[45] Date of Patent: Aug. 12, 1997

[54] SECURITY LOCKING DEVICE FOR COIN-OPERATED APPLIANCE

[76] Inventor: Charles J. DiRocco, Jr., 7400 Lakeview Dr. Apt. 308, Bethesda, Md. 20817

[21] Appl. No.: 620,607

[22] Filed: Mar. 22, 1996

[51] Int. Cl.[6] ..... D06F 39/14

[52] U.S. Cl. ..... 70/159; 68/12.26; 70/277; 70/281; 70/DIG. 41; 292/144; 292/DIG. 69

[58] Field of Search ..... 70/59, DIG. 30, 70/280–282, 271, 159–162, 277, DIG. 41, 267–269; 194/244, 248; 68/12.01, 12.02, 12.26; 292/144, DIG. 69

[56] References Cited

U.S. PATENT DOCUMENTS

| | | | |
|---|---|---|---|
| 3,673,824 | 7/1972 | Ripsco et al. | 68/12.26 |
| 3,784,776 | 1/1974 | Asanuma | 292/DIG. 69 X |
| 4,549,418 | 10/1985 | Hall | 70/85 |
| 4,663,538 | 5/1987 | Cotton et al. | 194/217 X |
| 5,172,577 | 12/1992 | Gibson | 292/DIG. 69 X |
| 5,263,344 | 11/1993 | Madison | 70/164 X |
| 5,412,825 | 5/1995 | Moon | 68/12.26 X |
| 5,520,026 | 5/1996 | Acklund | 292/DIG. 69 X |

FOREIGN PATENT DOCUMENTS

| | | | |
|---|---|---|---|
| 1010671 | 5/1977 | Canada | 292/DIG. 69 |

*Primary Examiner*—Lloyd A. Gall
*Attorney, Agent, or Firm*—Chenpatents

[57] ABSTRACT

A security locking device for coin-operated commercial washers and dryers for articles of clothing, bed linen, and the like, prevents the theft of such articles during the operation of the appliance by locking the door of the appliance. The security locking device functions in cooperation with the coin box and the appliance controls.

11 Claims, 3 Drawing Sheets

SECURITY LOCKING DEVICE FOR COIN-OPERATED APPLIANCE

I. BACKGROUND OF THE INVENTION

1. Field of Invention

This invention relates to a security locking device for coin-operated commercial appliances. Specifically, it relates to a security lock for coin-operated commercial washers and dryers used by the public, for articles of clothing, bed linen, and the like, which prevents the theft of such articles during and after the operation of the appliance.

2. Description of Prior Art

Security devices for commercial coin-operated appliances generally are directed to the protection of the coin boxes against theft. U.S. Pat. No. 4,406,358 provides a security guard for protecting the coin box of a coin-operated washing machine. U.S. Pat. No. 4,549,418 provides a removable lock box for coins. U.S. Pat. No. 5,263,344 provides a shield for protecting the coin box against vandalism.

Other known security devices prevent the opening of the doors of laundry appliances during operation at certain times to prevent injuries, or stop the operation of the appliance when the door is opened. U.S. Pat. No. 3,673,824 provides means for locking the doors of a laundry appliance while it is in operation, and preventing operation of the appliance when the door is open. U.S. Pat. No. 3,765,194 shows means for locking the appliance door during predetermined portions of the operating cycle of the appliance.

None of the devices of the prior art protect articles in coin-operated appliances in self-service laundry establishments used by the public, from being stolen while their owner is temporarily absent from the laundry establishment. There is a need, therefore, for security devices that prevent thieves from removing articles from coin-operated appliances, including automatic washers and dryers, while allowing the rightful owner of the articles access to the articles upon completion of the washing or drying cycle of the appliance.

It is the object of this invention to provide a security locking device for coin-operated laundry appliances, including washers and dryers, that prevents the opening of the appliance door during and after the operating cycle of the appliance, by anyone other than the rightful user of the appliance.

II. SUMMARY OF THE INVENTION

The security locking device of this invention is for coin-operated laundry appliances, including automatic washers and dryers, in laundry establishments open to the public. It enables the user of the appliance to lock its door during and after the operation of the appliance, affording protection against the theft of his articles or clothing, bed linen, and the like, while the user is temporarily absent from the laundry establishment.

The door of the appliance is locked by the user by a door latch which is positioned, either directly or indirectly, by an electrical solenoid.

In one embodiment of this invention, the solenoid acts directly upon an armature which is connected to a latch, advancing the latch and engaging the appliance door when the solenoid is energized. This embodiment may be undesirable in some appliances due to the physical layout of the appliance, and due to the possible electrical hazard created by an electrical part of the appliance that may be wet, or extremely moist, during the operation of the appliance.

In a preferred embodiment of this invention, the latch is operated remotely by means of a flexible, resilient wire attached to the armature of the solenoid, which is located in a location in the appliance where there is no electrical hazard due to water or moisture during the operation of the appliance. The latch is advanced to engage and lock the appliance door when the solenoid is energized.

In all embodiments of this invention, the solenoid is energized or de-energized by the action of an electrical switch actuated by the rotation of the cylinder of a safety lock having a key. The lock-and-key assembly has an "open" position corresponding to the appliance door being unlatched, and a "closed" position, in which the appliance door is locked. The key may be temporarily removed by the user of the appliance during and after its operation with the appliance door locked. Only the user, who is is in possession of the key, is able to unlatch the appliance door, open it, and remove the articles from the appliance. At a commercial laundry establishment, the proprietor may have a master key allowing access to all machines in the establishment.

The appliance door latch, key, lock, and other components are designed such that the key and appliance door latch cannot be activated, the key cannot be removed from the lock, and the appliance cannot be operated unless the required number of coins has been deposited in a coin box. This is accomplished by the use of electrical circuitry which supplies electric power to the lock-and-key assembly and to the appliance only after the required number of coins have been dropped into the coin box.

During the operation of the appliance, the appliance door may be unlocked for a brief interval by the user in possession of the key, and the door may be opened to add or remove pieces of clothing, locked again, and the operation cycle of the appliance completed. When the appliance door is opened during operation, the appliance stops; this feature is common in laundry appliances of the prior art and is not part of the present invention.

When the appliance has completed its cycle, the appliance door remains locked until the user of the appliance returns, inserts and turns the key in the lock, releasing the door latch, opens the door, and removes his articles of clothing. At this time, a manual reset switch may be activated, deactivating the electrical power supply to the appliance, Preferably, the reset switch should be triggered automatically when the door is being unlocked. At this point, only the insertion of coins into the coin box reactivates the system for its next operating cycle.

III. BRIEF DESCRIPTION OF DRAWINGS

Objects, features, and advantages of this invention will be readily apparent from the following description of certain preferred embodiments thereof, taken in conjunction with the accompanying drawings, although variations and modifications may be effected without departing from the spirit and scope of the novel concepts of this disclosure, and in which.

In all drawings, the same numeral refers to the same element of the invention.

IV. DETAILED DESCRIPTION OF PREFERRED EMBODIMENTS

This invention is directed to a security locking device in combination with a coin-operated laundry appliance open to the public, for preventing the theft of articles from the appliance, wherein the appliance has a coin box for receiving coins to start the operation of the appliance, a timer for controlling the operating cycle of the appliance, and a hinged door set in a door opening in the wall of the appliance, for access to the articles therein. The security locking device comprises a lock-and-key assembly electrically associated with said coin box; means connected to said lock-and-key assembly for actuating a latch to engage and lock the appliance door; and an electric circuit for supplying electric power for the operation of the appliance and the lock-and-key assembly, said electric circuit being energized after coins have been deposited in the coin box.

Turning the key in the lock in one direction actuates the latch to engage and lock the door, and turning the key in the lock in the opposite direction disengages the latch from the door.

The embodiments of the invention here described are for laundry appliances, including washers and dryers.

Means for actuating the latch is a solenoid having an energizable coil in electromagnetic communication with an armature connected to the latch through linkage means, whereby energizing the coil of the solenoid by electric power actuates the armature to cause the latch to engage and lock the door. The linkage means may consist of a flexible wire and a spring urging the latch to disengage from the door. Alternatively, the armature and the latch may be directly connected to each other.

The lock-and-key assembly has an "open" and a "closed" position. In the "closed" position, an electrical switch is closed, which causes the coil of the solenoid to be energized. In the "open" position, the switch is opened, causing the coil of the solenoid to be de-energized.

In the "open" position of the lock-and-key assembly, the key cannot be removed from the lock. In the "closed" position, the key may be removed from the lock. Until the electric circuit for supplying electric power to the appliance is energized by the deposition of coins in the coin box, the lock-and-key assembly is blocked in the "open" position and the key cannot be removed from the lock.

The electric circuit for controlling the power supply for the appliance and the relationship between the coin box and the lock-and-key assembly has several components which will be referred to as subcircuits herein.

Figure 1:
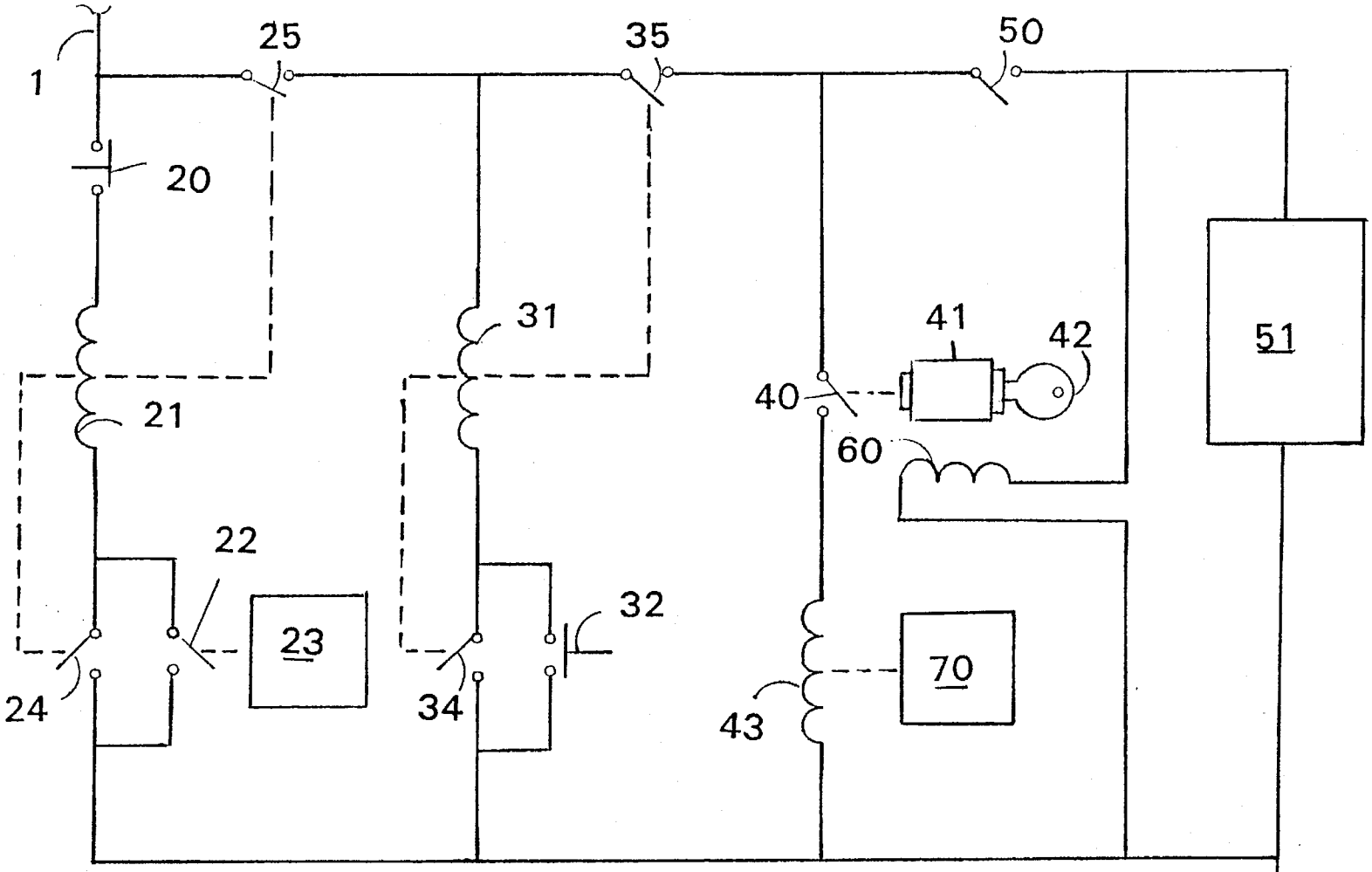
FIG. 1 is a partial wiring diagram showing connections between coin lock box, start and reset buttons, lock and key, solenoid, appliance door latch assembly, and the appliance.

With reference to FIG. 1, electrical alternating-current power, for example 120 volts AC, 60 Hz, is supplied at 1. Other AC voltages and frequencies, e.g., 220 volts and 50 Hz, or direct current, may alternatively be supplied. A first electric subcircuit comprises a reset switch 20, normally closed, a solenoid 21, and two single-pole-single-throw (SPST) switches connected in parallel (both normally open), the first such switch, 22, being closed for a brief interval when a sufficient number of coins has been deposited in a coin box 23. The switch 22 may be closed by a lever (not illustrated) activated by the deposition of coins into the coin box, or by a solenoid and armature (not illustrated). The switch 24 is closed by the solenoid 21 when it is energized. (The interaction of solenoids and switches is schematically represented by broken lines in all figures.)

Deposition of a sufficient number of coins energizes the first electric subcircuit by the following sequence of events: the coin box 23 causes the switch 22 to close energizing solenoid 21, closing switch 24, which keeps the solenoid 21 energized even after switch 22 opens, and which furthermore keeps switch 24 closed. Solenoid 21, when energized, also closes a SPST switch 25 (normally open) in a second subcircuit connected to the power supply at 1.

This second subcircuit comprises a pushbutton switch 32 (normally open) and, connected in parallel with it, a SPST switch 34 (normally open) which is closed when a solenoid 31 in series with the two switches is energized. The pushbutton switch is used as a manual start button for the appliance. A SPST switch 35 (normally open) is also actuated by solenoid 31 when energized and supplies electric power to a third subcircuit. It is to be noted that the solenoid 31, switches 32, 34 and 35 are optional features; they may be omitted, and electric power may be directly supplied to the third subcircuit of the system by closure of switch 25.

The third subcircuit further comprises a SPST switch 40 (normally open) which is closed by the action of a safety lock-and-key assembly including lock 41 and key 42. This lock-and-key assembly has two positions: an "open" position and a "closed" position. In the "open" position, switch 40 is open, and the key 42 cannot be removed from the lock 41. In the "closed" position, switch 40 is closed and the key may be removed from the lock 41.

Figure 2:
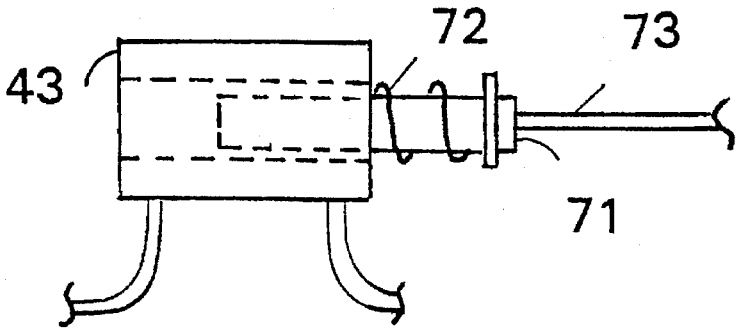
FIG. 2 is a schematic depiction of the solenoid and armature for actuating the appliance door latch.
Figure 3:
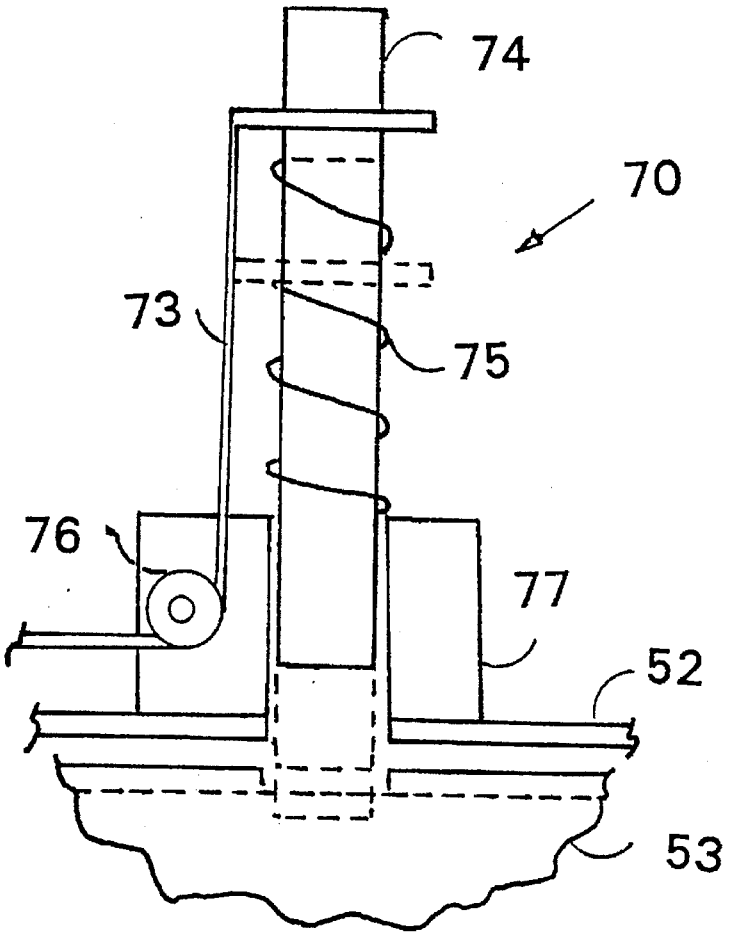
FIG. 3 illustrates the door latch assembly in accordance with a preferred embodiment of the invention, with the latch retracted; the position of the latch in the locking position, wherein it engages and locks the appliance door, is shown by broken lines.

Closing switch 40 energizes a solenoid 43. As shown in FIG. 2, this causes a spring-loaded armature 71 to be pulled into the solenoid coil 43 by magnetic force. As will be more fully discussed below, the motion of the armature 71 is transmitted to a door latch assembly 70, as shown in FIG. 3, advancing a spring-loaded latch 74 that locks the appliance door 53 when the solenoid 43 is energized, and retracting the latch and thereby unlocking the appliance door 53 when the solenoid 43 is de-energized.

A fourth subcircuit connected to the third circuit described above comprises a SPST switch 50 connected to the appliance door 53, the switch 50 being open when the appliance door 53 is open, and closed when the appliance door 53 is closed. It further comprises the wiring supplying electric power to the appliance 51 including, in the case of washers, hot and cold water supply solenoid valves, water level switches, agitator and motor,a pump, and a timer; in the case of electric dryers, electric heating elements, temperature controls, blower, tumbling basket motor and drive, etc.; and in the case of gas dryers, gas piping and valves, pilot burners, etc. All the components of laundry appliances are well known to the art and are not part of the present invention. They are not illustrated in the drawings. The electrical system is grounded at 80.

During the operation of the appliance, as a convenience to the users of the appliance, the key 42 may be used to turn the lock 41 to the "open" position, opening switch 40, de-energizing solenoid 43, releasing the door latch assembly 70, and retracting the latch locking the appliance door, which may now be opened. This allows the addition or removal of articles from the appliance during its cycle by the user of the appliance who is possession of the key. While the appliance door 53 is open and switch 50 is open, the power supply to the appliance 51 is interrupted and the appliance 51 stops operating. Selected appliance functions, such as the wash cycle in the case of washers, may continue; such a feature is not part of this invention and is not illustrated.

An additional safety feature which may be provided is a latch (not illustrated) on the lock 41 that blocks the lock in the "open" position unless a solenoid 60, as shown in FIG. 1, is energized. The cylinder of the lock 41 cannot be rotated and key-operated unless switch 25 is closed, which is the case only after the required number of coins have been deposited in the coin box 23.

It will be seen that after the appliance has completed its cycle, the appliance door continues to be locked until the user in possession of the key unlocks the door by inserting the key in the lock and turning it to the "open" position (switch 40 open, solenoid 43 de-energized, the door latch retracted, and the appliance door 53 unlocked). To complete the operating cycle of the appliance, the reset pushbutton switch 20 may be briefly depressed. This de-energizes solenoid 21 and opens switches 24 and 25, completely de-energizing the circuitry. The appliance cannot be used at this point until a sufficient number of coins is dropped into the coin box 23. Since a readily-accessible reset switch provides access to the contents of the appliance to potential thieves, preferably, the reset switch 20 is activated by the turning of the key 42 in the lock 41 from the "closed" to the "open" position if, and only if, the appliance has completed its cycle. A sensing relay that is activated when the appliance is drawing power from the supply circuit and that is deactivated when the appliance has completed its cycle and no longer draws power, may be used to determine whether the opening of the appliance door 53 triggers the reset switch 20.

As noted above, the solenoid 43 may either act directly or indirectly upon the appliance door latch 74. It was observed that mounting the solenoid 43 immediately next to the appliance door may be physically difficult in many appliances, or electrically unsafe due to the mounting of an electrical component in a part of the appliance that may be wet or extremely moist during appliance operation. It was observed, therefore, that indirect action of the solenoid 43 upon the appliance door latch 74 is a preferred embodiment of this invention.

With reference to FIG. 2, the solenoid 43 has a movable armature 71, which is drawn into the solenoid coil by magnetic force when its windings are energized, compressing a coil spring 72, and moving out of the solenoid coil by the action of spring 72 when the solenoid 43 is de-energized. Attached to the armature 71 is a flexible, resilient wire 73, the other end of which is attached to a spring-loaded latch 74 in the door latch assembly 70, illustrated by FIG. 3.

FIG. 3 shows one embodiment of the door latching assembly 70, which comprises a base 77, which is affixed to the appliance wall 52 near the appliance door 53. The base 77 has a passage in which latch 74 slides back and forth. The latch 74 normally is held in a retracted position by a spring 75; in this position, the latch does not engage the appliance door 53, which is thus unlocked. The position of the latch 74 in its locking position, projecting forward and engaging an opening on the appliance door 53, locking it, is shown with broken lines in FIG. 3. This position of the latch 74 results from the pulling action of the armature 71, transmitted to the latch 74 by wire 73, when the solenoid 43 is energized. A roller 76 is provided, rotatably affixed to base 77, having the flexible, resilient wire 73 looped around it to transmit the pulling action of the armature 71 to the latch 74.

Figure 4:
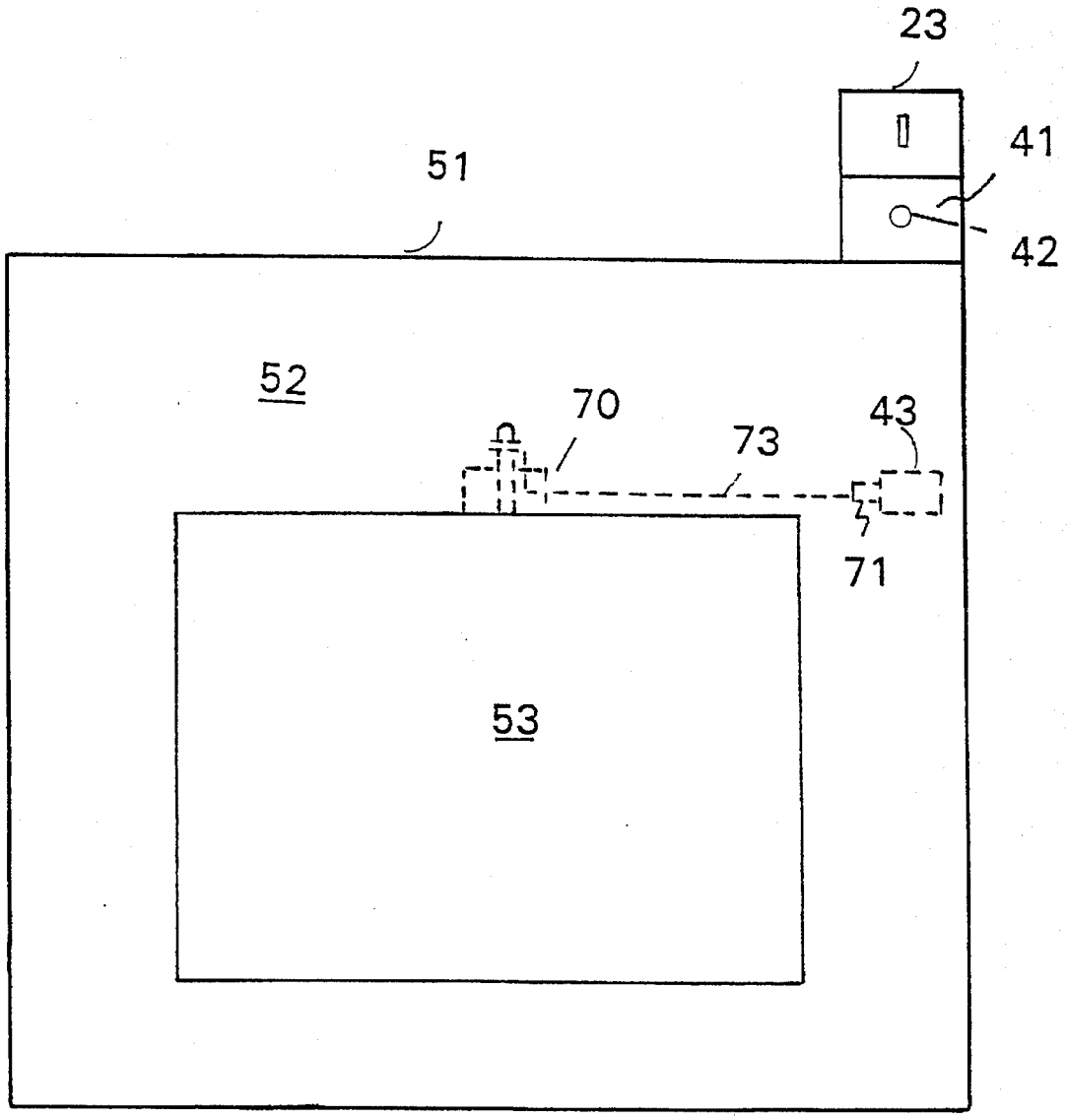
FIG. 4 illustrates one method of installing components of this invention in a laundry appliance.

With reference to FIG. 4, the solenoid 43 and the wiring between the switch 40, the lock 41, and the key 42 may be installed in a location in the appliance remote from water and moisture.

It will be appreciated by those skilled in the art that the above relationships between the coin box, the lock-and-key assembly, the latch for locking the appliance door, and the appliance may be accomplished by electric circuitry and circuit elements different from those illustrated in FIG. 1, and by mechanical means different from those illustrated in FIGS. 2, 3, and 4. In certain appliances, and with waterproof, moisture-proof wiring and solenoid, it may be safe to actuate the door latch directly with the solenoid and to dispense with the mechanical linkage between the solenoid, armature, and latch illustrated by FIGS. 2, 3, and 4. The feature for temporary access to the articles in the appliance during the appliance's cycle is for the convenience of the user. The self-actuated reset deactivating the system when the appliance door is opened after completion of the appliance's cycle, is for added protection of the articles in the appliance against theft.

It is to be understood that any and all embodiments of this invention that protect articles in laundry appliances from theft during and after the operation of the appliance by use of an access key, lock, and door latching means in conjunction with a coin box fall within the scope of this invention as defined by the appended claims.

What is claimed is:

1. A security locking device in combination with a coin-operated laundry appliance for preventing the theft of articles from the appliance, wherein the appliance has a coin box for receiving coins to start the operation of the appliance, a timer for controlling the operating cycle of the appliance, and a hinged door set in a door opening in a wall of the appliance, for access to the articles therein; comprising (a) a lock-and-key assembly electrically associated with said coin box;

(b) means connected to said lock-and-key assembly for actuating a latch to engage and lock the appliance door; and (c) an electric circuit for supplying electric power for the operation of the appliance and the lock-and-key assembly, said electric circuit being energized after coins have been deposited in the coin box;

whereby turning the key in the lock in one direction actuates the latch to engage and lock the door, and turning the key in the lock in the opposite direction disengages the latch from the door.

2. The combination of claim 1 wherein the means for actuating the latch is a solenoid having an energizable coil in electromagnetic communication with an armature connected to the latch through linkage means, whereby energizing the coil of the solenoid by electric power actuates the armature to cause the latch to engage and lock the door.

3. The combination of claim 2 wherein the linkage means comprises a flexible wire and a spring urging the latch to disengage from the door.

4. The combination of claim 2 wherein the lock-and-key assembly has an "open" position and a "closed" position; and wherein in the "closed" position, an electric switch is closed which causes the coil of the solenoid to be energized; and wherein in the "open" position, the electric switch is opened, causing the coil of the solenoid to be de-energized.

5. The combination of claim 1 wherein the means for actuating the latch is a solenoid having an energizable coil in electromagnetic communication with an armature capable of being directly affixed to the latch, whereby energizing the coil of the solenoid by electric power actuates the armature to cause the latch to engage and lock the door.

6. The combination of claim 3 wherein the armature is connected to a flexible wire at one end, the other end of the wire being connected to the latch, whereby the latch is pulled by the armature and wire to engage and lock the door when the coil of the solenoid is energized.

7. The combination of claim 4 wherein the key cannot be removed from the lock in the "open" position; and the key can be removed from the lock in the "closed" position.

8. The combination of claim 4 wherein the lock-and-key assembly is blocked in the "open" position and the key cannot be removed from the lock when the electric circuit is not energized.

9. The combination of claim 1 further comprising a normally-closed reset switch wherein the temporary opening of the reset switch de-energizes the circuit.

10. The combination of claim 9 wherein the reset switch is opened by turning the lock-and-key assembly to an "open" position when the cycle timer has completed the operating cycle of the appliance.

11. The combination of claim 4 wherein, during the operating cycle of the appliance, the appliance door may be unlocked and opened, and closed and locked, by the turning of the key in the lock to the "open" and "closed" positions, respectively.

* * * * *